US012447388B2

(12) United States Patent
Redmond et al.

(10) Patent No.: US 12,447,388 B2
(45) Date of Patent: Oct. 21, 2025

(54) FLOATING GOLF TARGET

(71) Applicant: AquaShotGolf LLC, Phoenix, AZ (US)

(72) Inventors: Raymond Redmond, Lighthouse Point, FL (US); Todd Brenneman, Phoenix, AZ (US)

(73) Assignee: AquaShotGolf LLC., Phoenix, AZ (US)

( * ) Notice: Subject to any disclaimer, the term of this patent is extended or adjusted under 35 U.S.C. 154(b) by 756 days.

(21) Appl. No.: 17/841,894

(22) Filed: Jun. 16, 2022

(65) Prior Publication Data

US 2022/0401807 A1 Dec. 22, 2022

Related U.S. Application Data

(60) Provisional application No. 63/212,899, filed on Jun. 21, 2021.

(51) Int. Cl.

| | |
|---|---|
| ***A63B 67/02*** | (2006.01) |
| ***A63B 67/00*** | (2006.01) |
| ***A63B 69/36*** | (2006.01) |

(52) U.S. Cl.

CPC ..... *A63B 67/02* (2013.01); *A63B 67/007* (2013.01); *A63B 69/3691* (2013.01); *A63B 2225/605* (2013.01)

(58) Field of Classification Search

CPC ... A63B 67/02; A63B 67/007; A63B 69/3691; A63B 2225/605

USPC ..... 473/173

See application file for complete search history.

(56) References Cited

U.S. PATENT DOCUMENTS

| | | | | | |
|---|---|---|---|---|---|
| 2,767,501 | A | * | 10/1956 | Bjorksten | A01K 73/12 43/7 |
| 3,104,879 | A | | 9/1963 | Jetton | |
| 3,413,005 | A | * | 11/1968 | Stearns | A63B 63/08 473/192 |
| 3,649,025 | A | * | 3/1972 | Garland | A63B 47/025 273/350 |
| 3,797,827 | A | * | 3/1974 | Child | A63B 47/025 473/166 |
| 3,814,439 | A | | 6/1974 | Simon | |

(Continued)

FOREIGN PATENT DOCUMENTS

| | | | | | |
|---|---|---|---|---|---|
| DE | 19860331 | A1 | * | 6/2000 | A63B 47/025 |
| KR | 20170127644 | A | * | 5/2016 | |
| WO | WO-2008132270 | A1 | * | 11/2008 | A63B 57/357 |

OTHER PUBLICATIONS

"PGA Tour Floating Golf Green" by All Kids Golf Clubs; https://allkidsgolfclubs.com/products/pga-tour-floating-golf-green (Year: 2025).*

*Primary Examiner* — Samir Abdosh

(74) *Attorney, Agent, or Firm* — Weisberg I.P. Law, P.A.

(57) ABSTRACT

A golf target for use on a body of water having a water surface is described. The golf target comprises a first float having a first diameter and a second float having a second diameter smaller than the first diameter. The golf target also comprises a mesh having an outer perimeter, a mesh center, and a middle portion extending between the outer perimeter and the mesh center. The outer perimeter of the mesh is affixed to the first float, and the mesh center is affixed to the second float. At least a part of the middle portion is arranged to submerge under the water surface when the golf target is floated on the body of water.

19 Claims, 9 Drawing Sheets

(56) References Cited

U.S. PATENT DOCUMENTS

| | | | | |
|---|---|---|---|---|
| 4,576,375 | A | 3/1986 | Roberts | |
| 5,240,246 | A * | 8/1993 | Gohil | A63B 47/024 473/197 |
| 5,830,076 | A | 11/1998 | Borys | |
| 5,993,322 | A * | 11/1999 | Consalvi | A63B 69/3694 473/168 |
| 7,056,221 | B2 * | 6/2006 | Thirkettle | A63B 71/06 473/192 |
| 10,173,118 | B1 | 1/2019 | Lawrence | |
| 2002/0098899 | A1 | 7/2002 | Newcomb et al. | |
| 2003/0134549 | A1 | 7/2003 | Lekhtman | |
| 2015/0273300 | A1 * | 10/2015 | Bartz | A63B 67/02 473/158 |
| 2022/0401807 | A1 * | 12/2022 | Redmond | A63B 69/3691 |

* cited by examiner

FLOATING GOLF TARGET

CROSS-REFERENCE TO RELATED APPLICATION

This application is related to and claims priority to U.S. Provisional Patent Application Ser. No. 63/212,899, filed Jun. 21, 2021, entitled FLOATING GOLF TARGET, the entirety of which is incorporated herein by reference.

TECHNICAL FIELD

This disclosure relates to apparatuses for physical training, and in particular to a floating golf target.

BACKGROUND

Golf chipping in a golf game is one of the most important techniques to have in a golfer's repertoire but is also one of the hardest to master. More specifically, golf chipping requires getting a golf ball to leap into the air to a certain height and roll as close as possible towards a golf hole or flag stick. Various strategies and stances to achieve a successful chip shot are required. In addition, several factors to successful chipping should be considered such as type of obstacles around a green, current distance from the golf hole, type and length of grass being playing on, etc. Notwithstanding, three basic chipping types form the crux of all modified chipping methods in use today. The three basic chipping types include the soft chip (i.e., lob shot), the low chip, and the standard chip.

Among the basic golf chipping methods, the soft chip, or lob shot, is the chip which gives the golf ball the highest leap and lowest roll towards the golf hole of the three basic chipping types. A golf ball that is hit using soft chip type typically lands close to the golf hole. For example, a soft chip is usually used when there is an obstacle in the direct line of a chip, and the golf ball is close to the hole. A soft chip is achieved by letting the club hit the golf ball with the club face open and with moderate acceleration behind the swing. Clubs that are considered to be the most appropriate for soft chips include clubs typically known as sand wedge and lob wedge. These clubs are considered the most appropriate because of their high loft and capability to deliver a low roll.

Of all the basic golf chips, the low chip is the chip that delivers the longest roll on the green. The low chip is used when there is a large distance from the flag stick to the golf ball location. Further, the low chip shot may be timed to spend about half the time in the air and the other half to roll on the green. Common clubs used for low chipping include clubs known as five iron, six iron, and other mid-irons.

The standard chip appears to be the standard from which golf chipping was developed. In a successful standard chip, the golf ball travels to the golf hole at a ratio of two-thirds of the time in the air and a roll of one third of the time on the green. Any club may be used for a standard chip, although the most common clubs used include clubs known as pitching wedge, gentle nine, and sand wedge.

Besides practicing on a golf course, a golfer may also practice golf chipping using typical pool-side golf products and/or backyard chipping products. However, these products suffer from various drawbacks. For example, typical pool-side products include toy features, rather than features that are typical of a training tool that improves a golfer's skills. Floating "greens" of artificial turf is typically employed in addition to non-golf balls, e.g., plastic, rubber, or Velcro balls. The "greens" of artificial turf and non-golf balls are not the same as the actual turf and the golf balls used for an actual round on the golf course. Therefore, a shot required to hit the "greens" in a typical product does not simulate hitting an actual chip shot. In addition to the drawbacks of pool-side golf products, typical backyard chipping products generally employ either a netting target or features that resemble a bean-bag game or a corn hole game. Further, the balls typically used and/or provided with typical backyard chipping products do not provide the actual feel of hitting a golf ball. Although golf balls may be used with either one of the typical pool-side golf products and backyard chipping products, golf balls only exacerbate the drawbacks of these products, e.g., golf balls typically bounce off, rather than being received as in an actual chip shot. Therefore, using golf balls with typical products leads to frustration, lost interest and lack of simulation of being on the golf course. In sum, typical products do not facilitate skill development nor simulate actual chip shots.

SUMMARY

Some embodiments advantageously provide a golf target that floats and receives golf balls. Some other embodiments allow golfers to practice golf chipping by placing the floating golf target in a body of water, e.g., by placing the floating golf target on the water of a pool, and practice golf chipping with golf balls such as "real-feel" golf balls. More than one floating golf target may be used. Since mastering golf chipping involves arduous practice, the capability of the floating golf target to receive the golf balls, as in an actual golf chipping environment, does not lead to frustration and maintains the competitive spirt of game.

In some other embodiments, the golf target allows golfers (e.g., pool-owning (or waterfront home owning) golfers) and/or others to practice shots such as key shots at home with real-feel golf balls and have fun at the same time. The golf targets may be arranged to have more than one size such as arranged to be hyper-critical (small) targets, which combined with a fun/competitive aspect allows golfers to keep the focus over a lengthy period of time. The size of the golf targets may also be adjustable.

In one embodiment, the golf target has at least an edge over typical products on the market by combining real-feel of golf balls that mimic (i.e., simulate) actual playing conditions e.g., rather than plastic whiffle balls or Velcro-wrapped plastic balls, with the clear feedback of hitting or not hitting a desired target, in addition to the fun of practicing around a pool or open body of water In another embodiment, a starter kit is comprised of at least one of the following different components:

One or more golf targets (e.g., three golf targets such as three target rings—A truly unique component is the golf target, e.g., floating circular target or ring. Each golf target includes at least a first float;

For each golf target, a second float, i.e., three second floats, e.g., three custom molded floating center flag holder—This component adds to the uniqueness of each golf target, e.g., target ring. The second float may be arranged to attach, using for example, a hook and/or loop fastener, to the center of mesh, e.g., the inner mesh, in golf target, e.g., the target ring. The second float, e.g., floating center, may be arranged to hold a flagpole and/or flag and/or allow the mesh to billow beneath the water surface, e.g., to create a dampening effect to "catch" golf balls when the golf balls enter the golf target. The dampening effects avoids undesired bouncing of the golf ball out of and/or away from the golf target;

One or more flags and/or flagpoles—These may be arranged to be inserted into the second float, e.g., floating center, and/or provide focused aiming points within the golf targets;

One or more floating golf balls—; and

One or more tethering cord and/or clips—One or more stretchable cords and/or clips may be included, e.g., to secure the target rings together and/or to various points around the pool and/or to the anchor bags supplied with the kit.

According to one aspect of the present disclosure, a golf target for use on a body of water having a water surface is described. The golf target comprises a first float having a first diameter, a second float having a second diameter smaller than the first diameter, and a mesh. The mesh has an outer perimeter, a mesh center, and a middle portion extending between the outer perimeter and the mesh center. The outer perimeter of the mesh is affixed to the first float. The mesh center is affixed to the second float. In addition, at least a part of the middle portion is arranged to submerge under the water surface when the golf target is floated on the body of water.

In some embodiments of this aspect, the first float further includes a spring coupled to the first float, the spring being arranged to exert a biasing force at least on one of the first float and the outer perimeter of the mesh, at least one of the first float and the outer perimeter of the mesh being pulled away from the second float when the biasing force is applied.

The first float includes an inner tube surrounded by a fabric having at least an outer surface. The first float further includes a spring coupled to the outer surface.

In some other embodiments, the first float further includes a spring casing being attached to the outer surface of the fabric and encasing the spring, where the spring is indirectly coupled to the outer surface by being encased by the spring casing.

In one embodiment, the outer surface of the fabric surrounding the inner tube of the first float includes at least a bottom outer surface, and the outer perimeter of the mesh is affixed to the first float by being affixed to the bottom outer surface. At least a part of the bottom outer surface is submerged under the water surface when the golf target is floated on the body of water.

In one other embodiment, the second float is at least one of molded, disc shaped, and includes a base portion and a top portion having a conical shape.

In another embodiment, the golf target further includes an aiming device which includes a flagpole and a flag attached to the flagpole. The flagpole has at least a flagpole bottom portion. The conical shape of the top portion of the second float is a truncated cone having at least a top area, where the top area includes a flagpole coupling mechanism. The flagpole coupling mechanism receives the flagpole bottom portion to couple the flagpole to the second float.

In some other embodiments, the base portion of the second float includes a base portion bottom surface, and the mesh center is affixed to the second float by being affixed to the base portion bottom surface, at least a part of the base portion bottom surface being submerged under the water surface when the golf target is floated on the body of water.

In an embodiment, at least the part of the middle portion of the mesh is arranged to submerge under the water surface when the golf target is floated on the body of water by having a concave cross section between the outer perimeter of the mesh and the mesh center.

In another embodiment, the first float further includes a plurality of cords and a plurality of loops. Each loop of the plurality of loops is affixed to the first float, and each cord of the plurality of cords has a first cord end and a second cord end. The first cord end of each cord of the plurality of cords is tied to one corresponding loop of the plurality of loops.

In on embodiment, the second cord end of each cord of the plurality of cords may be tied to any one of another golf target, a surface containing the body of water, and each other second cord end of each cord.

In another embodiment, each loop of the plurality of loops is affixed to the outer surface of the fabric surrounding the inner tube of the first float.

In some embodiments, the golf target further includes an anchor bag and an anchor cord. The anchor cord has a first anchor cord end and a second anchor cord end. The first anchor cord end is tied to the second cord end of each cord of the plurality of cords, and the second anchor cord end is tied to the anchor bag.

In some other embodiments, the anchor bag includes an anchor attachment that has a drawstring in form of a loop, a drawstring channel, and a drawstring lock. The drawstring is slidable through the drawstring channel and through the drawstring lock. The drawstring lock has an unlocked position and a locked position. The drawstring lock prevents the drawstring from sliding through the drawstring lock and creates an attachment loop when in the locked position.

In an embodiment, the second anchor cord end is tied to the anchor bag by tying the second anchor cord end to the drawstring on the attachment loop.

In another embodiment, the anchor bag is arranged to receive an anchor weight, which causes the anchor bag to sink in the body of water and prevents the golf target from moving away from a predefined area of the body of water.

According to another aspect, a golf target for use on a body of water having a water surface is described. The golf target comprising: a first float having a first diameter, where the first float includes an inner tube surrounded by a fabric having at least an outer surface, the outer surface of the fabric surrounds the inner tube of the first float including at least a bottom outer surface; a second float having a second diameter smaller than the first diameter; a mesh having an outer perimeter, a mesh center, and a middle portion extending between the outer perimeter and the mesh center. The outer perimeter of the mesh is affixed to the first float. The mesh center is affixed to the second float. The outer perimeter of the mesh is affixed to the first float by being affixed to the bottom outer surface. At least a first part of the middle portion of the mesh and a second part of the bottom outer surface is arranged to submerge under the water surface when the golf target is floated on the body of water. The at least first part has a concave cross section between the outer perimeter of the mesh and the mesh center.

According to one aspect, a golf training system is described. The golf training system includes a golf target for use on a body of water having a water surface. The golf target includes a first float having a first diameter. The first float includes an inner tube surrounded by a fabric having at least an outer surface. The outer surface of the fabric surrounds the inner tube of the first float including at least a bottom outer surface. The golf target also includes a second float having a second diameter smaller than the first diameter, and a mesh having an outer perimeter, a mesh center, and a middle portion extending between the outer perimeter and the mesh center. The outer perimeter of the mesh is affixed to the first float. The mesh center being affixed to the second float. The outer perimeter of the mesh is affixed to the first float by being affixed to the bottom outer surface. At least a first part of the middle portion of the mesh and a second part of the bottom outer surface is arranged to submerge under the water surface when the golf target is floated on the body of water. The at least first part has a concave cross section between the outer perimeter of the mesh and the mesh center. The golf training system also includes at least a floatable golf ball, the at least floatable golf ball being receivable at least in part by at least one of the first float, the second float, and the mesh.

In some embodiments, the second float is a golf hole arranged to receive the at least floatable golf ball.

In some other embodiments, the golf training system further includes a carrying case having a case mesh.

BRIEF DESCRIPTION OF THE DRAWINGS

A more complete understanding of embodiments described herein, and the attendant advantages and features thereof, will be more readily understood by reference to the following detailed description when considered in conjunction with the accompanying drawings wherein.

DETAILED DESCRIPTION

Figure 1:
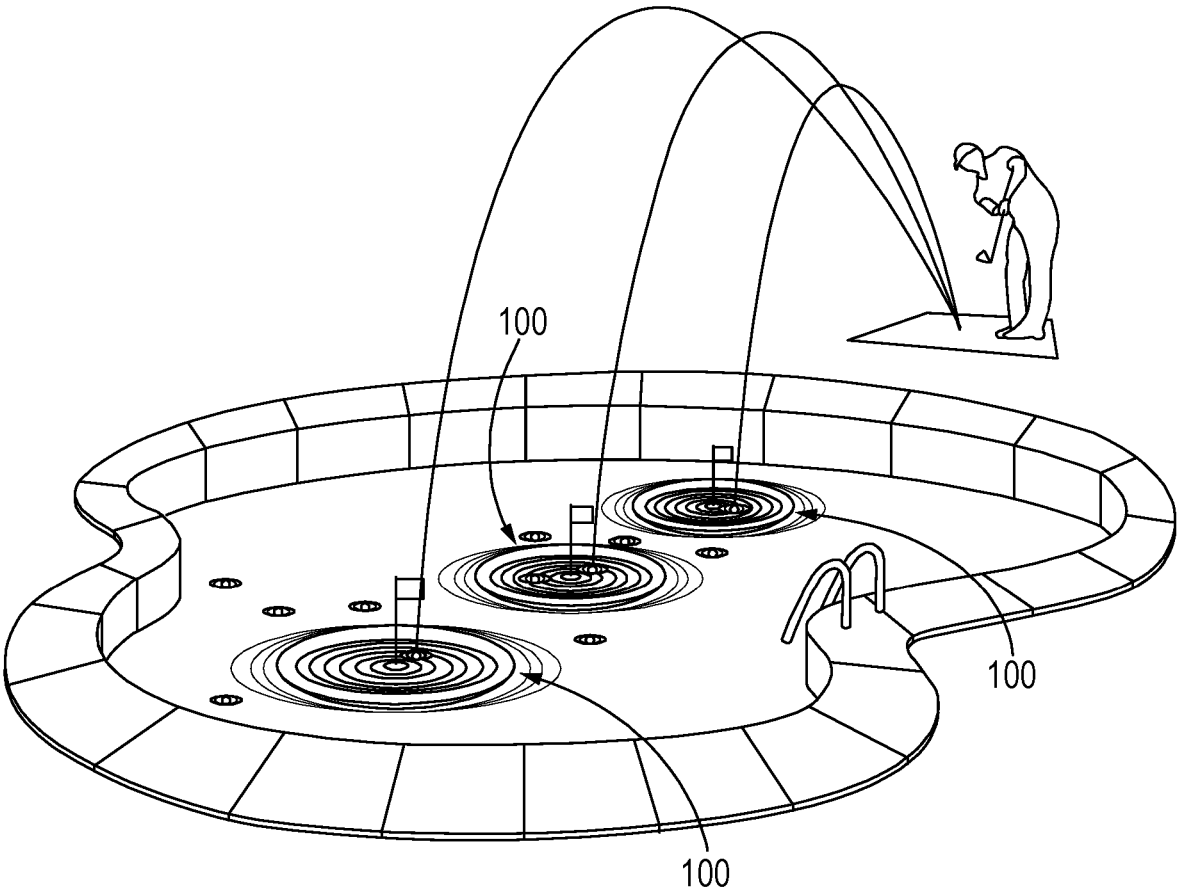
FIG. 1 shows an example arrangement of multiple golf targets in a body of water according to the principles of the present disclosure.

Before describing in detail exemplary embodiments, it is noted that the embodiments reside primarily in combinations of apparatus components of a floating golf target. Accordingly, the system, apparatus, and method components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

As used herein, relational terms, such as "first" and "second," "top" and "bottom," and the like, may be used solely to distinguish one entity or element from another entity or element without necessarily requiring or implying any physical or logical relationship or order between such entities or elements. The terminology used herein is for the purpose of describing particular embodiments only and is not intended to be limiting of the concepts described herein. As used herein, the singular forms "a", "an" and "the" are intended to include the plural forms as well, unless the context clearly indicates otherwise. It will be further understood that the terms "comprises," "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

Referring to the drawing figures, in which like elements are referred to by like reference numerals, there is shown in FIG. 1 an example arrangement of multiple golf targets in a body of water. More specifically, each golf target 100 is floatable in a body of water such as a swimming pool. A golfer can practice shooting golf balls at each golf target 100. When a golf ball is properly shot and hits a golf target 100, the golf target 100 receives the golf ball (i.e., rather than bouncing the golf ball out and away from the golf target 100 as in typical golf targets, where the golf ball bounces to and lands on the water instead). In FIG. 1, three golf targets 100 are shown, and the golfer hits three golf balls, each ball hits one golf target 100 and is received by the golf target 100. Although three golf targets 100 are shown, the present disclosure is not limited as such, and one or more golf targets 100 may be used. In a nonlimiting example based on a typical home swimming pool size, each golf target 100 may be spaced out anywhere from 2-yard shots to 15-yard shots. Spacing between each golf target 100 is not limited to 2-yard shots to 15-yard shots and may be spaced out in any manner. Also, in another nonlimiting example, the golf target 100 may have an overall diameter of 33" but is not limited to being 33" and can have any overall diameter. Further, the golf target 100 is not limited to having a circular shape and may have any shape.

Figure 2:
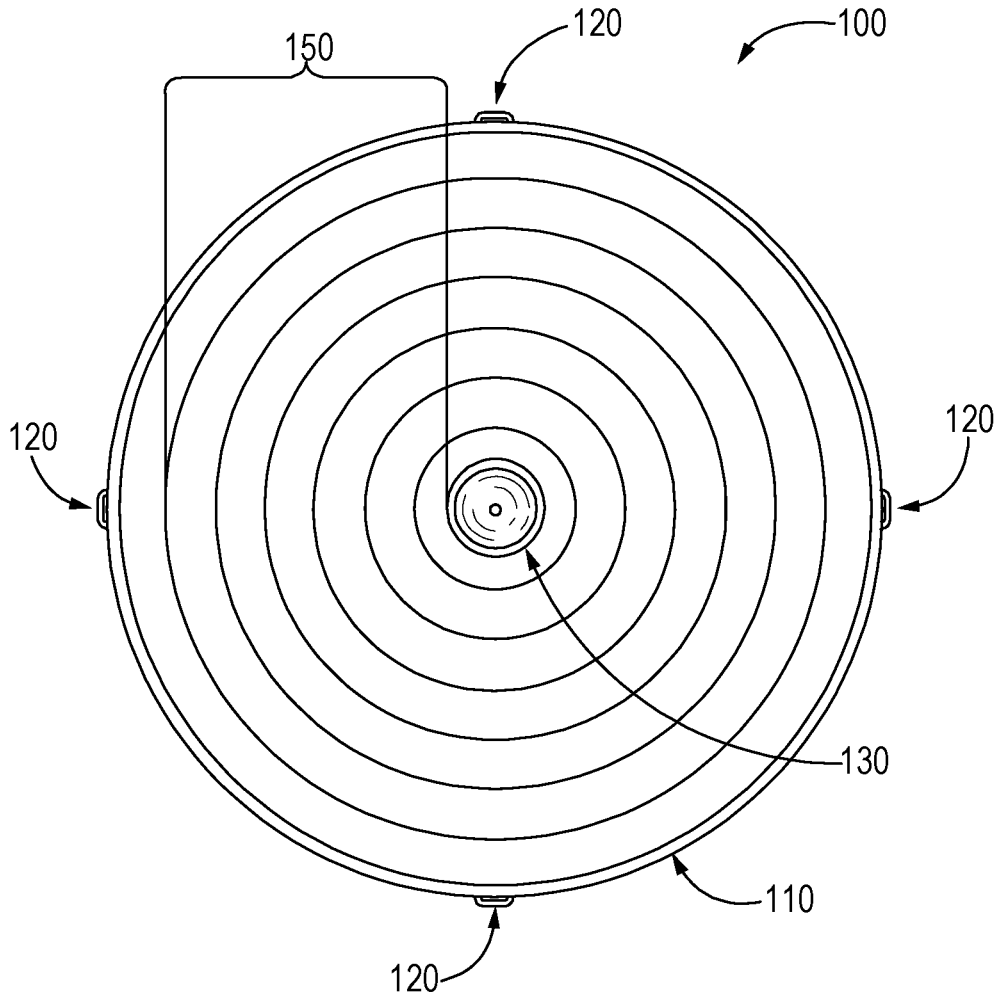
FIG. 2 shows a top view of an example golf target according to the principles of the present disclosure.

FIG. 2 is a top view of an example golf target. More specifically, golf target 100 includes a first float 110 and a second float 130, where the diameter of the first float 110 is larger than the diameter of the second float 130. In addition, the first float 110 and the second float 130 are shown as being co-axial (e.g., concentric) but are not limited as such and may be arranged in any other configuration. A mesh 150 is provided between the first float 110 and the second float 130. Although the mesh 150 is shown on the left side of the second float, it is understood that the mesh 150 may extend radially from the second float 130 to the first float 110. Extending radially from the second float 130 is understood as extending from any portion of the second float 130 and/or any portion of the golf target 100. Similarly, extending radially to the first float 110 is understood as extending to any portion of the first float 110 and/or extend beyond the first float 110. However, mesh 150 is not limited to extending radially as described and may be extend in any other way. In a nonlimiting example, the mesh 150 includes six concentric rings showing a pattern of a target, but the mesh 150 is not limited to having six concentric rings showing the pattern of a target. Mesh 150 may include any number of rings (e.g., printed rings), any figure other than rings, or no figure at all. Further, golf target 100 may include at least one loop 120, which may be a tab or any other member capable of receiving a cord to tie to the loop and/or any component of golf target 100. Loop 120 may be affixed and/or coupled (e.g., releasably coupled) to any component of golf target 100 such as first float 110. Further, loop 120 may be arranged to secure golf target 100, e.g., by keeping golf target 100 within a predetermined area on the surface of the body of water at least when loop 120 receives a cord. Four loops 120 are shown, but the golf target 100 is not limited to having four loops 120 and may have more than or fewer than four loops 120.

In another nonlimiting example, the second float 130 may include and/or be a golf hole arranged to receive golf balls. Accordingly, the second float may include and/or be a golf hole of cylindrical shape having a predetermined volume and being capable of receiving a predetermined quantity of golf balls. A golf ball may hit golf target 100 and/or land directly within the golf hole of second float 130 and/or hit other components of golf target 100 and indirectly land within the golf hole of second float 130. If the predetermined quantity of golf balls is exceeded, additional golf balls that land withing second float 130 may bounce to and/or roll off to and/or be captured within and/or surrounded by other components of golf target 100. Although a cylindrical shape is described, the golf hole included in the second float 130 is not limited to the cylindrical shape and may be any other shape. Similarly, although the golf target 100 is shown in a circular shape, the golf target 100 is not limited to the circular shape and may be of any shape.

The golf target 100 may be arranged to float when placed on a body of liquid, i.e., a floating golf target, or a floatable golf target. Floating and floatable may be used interchangeably. Although buoyancy of the golf target 100 may be achieved by any element of the golf target 100, either one of the first float 110 or the second float 130 provides sufficient buoyancy for the golf target 100 to float in a body of liquid, e.g., fresh water, salt water, treated water, untreated water, or any other type of water, etc. Other liquids may also be used in conjunction with the golf target 100.

Figure 3:
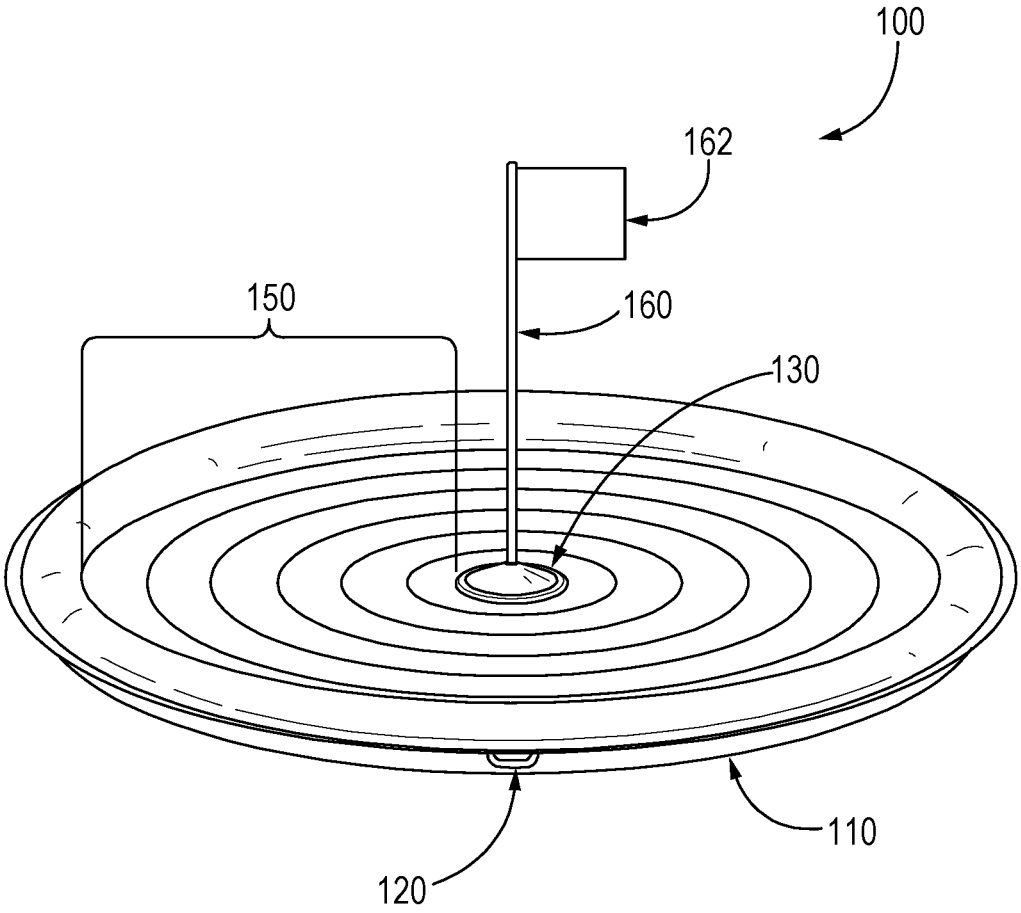
FIG. 3 shows a perspective view of another example golf target including a flagpole and flag according to the principles of the present disclosure.

FIG. 3 is a perspective view of another example golf target including a flagpole and flag. More specifically, golf target 100 includes a first float 110 and a second float 130, where the diameter of the first float 110 is larger than the diameter of the second float 130. A mesh 150 is shown extending radially between the first float 110 and the second float 130. The example golf target 100 also includes a flagpole 160 and a flag 162 attached to the flagpole 160. The flagpole 160 is attached to the second float 130. Coupling the flag 162 to the flagpole 160 and/or coupling the flagpole 160 to the second float 130 may include any one of stitching, gluing, attaching, releasably coupling, sliding, tying, mounting, affixing, securing, pinning, latching, and screwing. Any other type of coupling may be included. In addition, flag 162 may have any shape, be made of any material, and/or include a figure, e.g., a logo. For example, flag 162 may be any kind of aiming device, e.g., light, sphere, prism, ring, etc.

Figure 4:
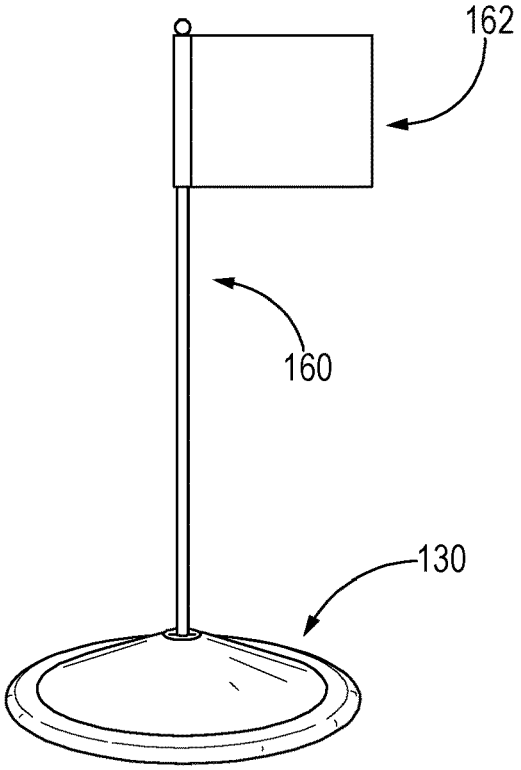
FIG. 4 shows an example second float as a disc holding a flagpole including a flag according to the principles of the present disclosure.

FIG. 4 shows an example second float as a disc, e.g., a conical-shaped disc, holding a flagpole including a flag. Second float 130 of FIG. 4 may be a disc, e.g., a conical-shaped disc, and the flagpole 160 may include one threaded end usable to couple the flagpole 160 the second float 130. Flagpole 160 be removably secured to the second float 130, e.g., using any type of fastener and/or fastener member such as a nut, washer, etc. In other words, the fastener member may be threaded so that the fastener member can be tightened on the threaded end of the flagpole 160 to secure the flagpole 160 to the second float 130. Further, flagpole 160 may be held in place by compression, e.g., using a custom-formed compression-type portal in the top of the second float 130, e.g., an Ethylene-Vinyl Acetate (EVA) molded float. The flagpole 160 may be snugly held in place by compression, e.g., provided by the form of the second float 130, and/or be removable. Any other securing methods and/or fastening methods and/or components may be employed. The second float 130 in this nonlimiting example may be a foam disc or a disc of any other material that provides buoyancy.

Figure 5:
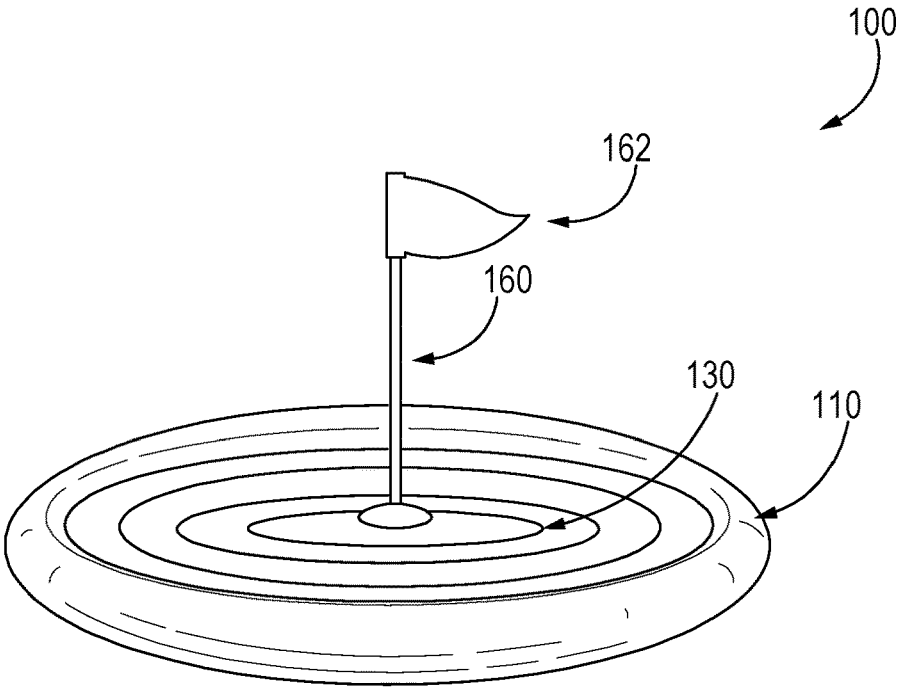
FIG. 5 shows an example golf target including a second float as a disc holding a flagpole including a flag according to the principles of the present disclosure.

FIG. 5 shows an example golf target including a second float as a disc holding a flagpole including a flag. More specifically, the example golf target 100 includes the second float 130 which may be a conical-shaped EVA-formed disc, a Styrofoam disc, or a disc of any other material that provides buoyancy. In addition, buoyancy is also provided at least by the first float 110, i.e., allowing the golf target to float and the flagpole 160 and flag 162 to provide focused aiming points within the golf target 100.

Figure 6:
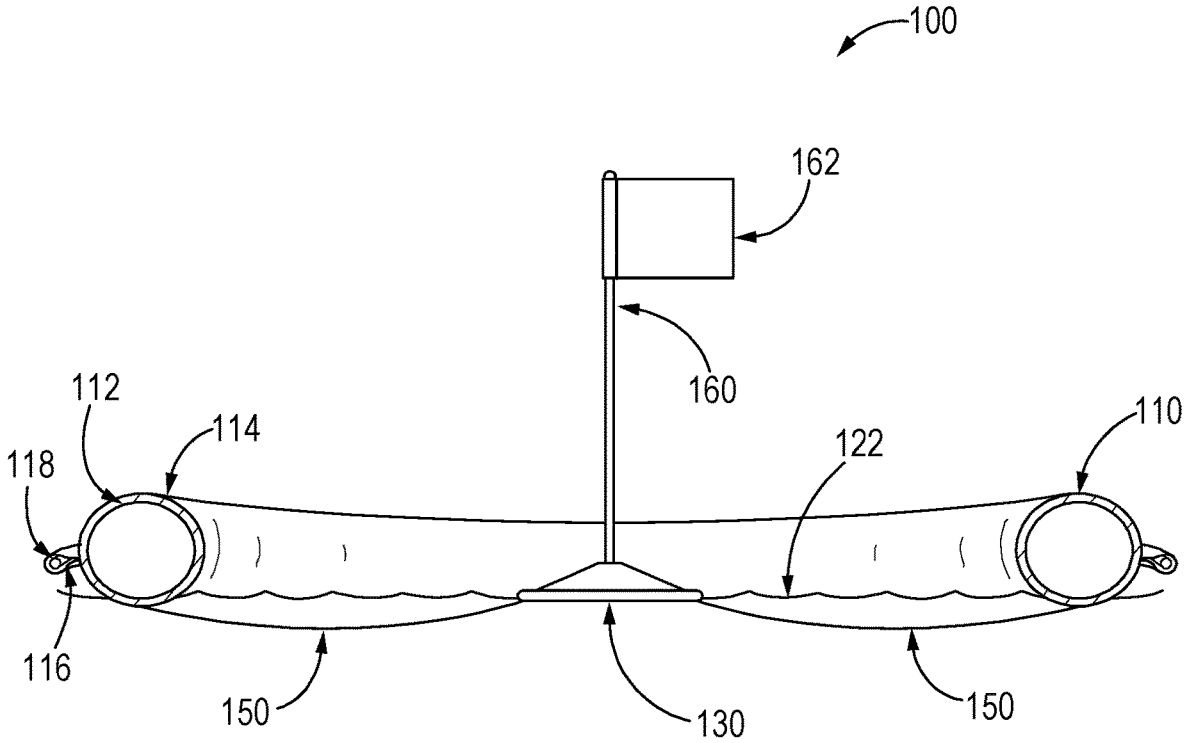
FIG. 6 shows a cross-sectional view of an example golf target including a mesh that bows below the water surface according to the principles of the present disclosure.

FIG. 6 shows a cross-sectional view of an example golf target including a mesh that bows below the water surface, i.e., has a concave shaped cross section. First float 110 includes an inner tube 112. The inner tube 112 may have a wall of predetermined width and be filled with any one of a gas, liquid, or solid. In one non limiting example, the inner tube 112 may be filled with air (e.g., being inflatable). In another nonlimiting example, the inner tube is filled with a foam. In other words, inner tube 112 may be arranged to provide buoyancy to golf target 100 and/or provide absorption such as when a golf ball hits first float 110, at least some of the energy associated with the golf is absorbed, e.g., to ensure that the golf ball lands within golf target 100. Although inner tube 112 is described as being filled with air or foam, inner tube 112 is not limited as such and can be filled with any other material, e.g., that provides buoyancy and/or energy absorption The inner tube 112 may also be surrounded by and/or encased by and/or coupled to an outer tube 114, which may be made of a fabric, where the fabric may have at least an outer surface. The first float 110 may also include a spring casing 116 and a spring 118. The spring casing 116 may be coupled to first float 110 (e.g., the outer surface of the outer tube 114) and encasing the spring 118. Spring 118 may be coupled to the first float 110. Spring 118 may be arranged to exert a biasing force at least on one of the first float 110 and the outer perimeter of the mesh 150. At least one of the first float 110 and the outer perimeter of the mesh 150 may be pulled away from the second float 130 when the biasing force is applied.

The second float 130 may include flagpole 160, which may have flag 162 attached. Mesh 150 may extend radially from the second float 130 to the first float 110. Further, mesh 150 bows below the water surface 122. Bowing may refer to having a concave cross section, billowing, etc. Although an entirety of the mesh 150 is shown as bowing under the water surface 122, mesh 150 may be arranged so that a portion, e.g., a middle portion, of mesh 150 is under the water surface 122. Mesh 150 (and/or other components of golf target 100) may be arranged to catch/receive one or more golf balls. Put differently, having mesh 150, or a portion of the mesh 150, bow under the water creates a functional "ball catch." In a nonlimiting example, in order for the ball to be "caught", a combination of water and the mesh 150 that is at least in part below the water surface by a predetermined amount, e.g., ¾ inch to 1 inch below the water surface, terminates all types of ball spin speeds and/or absorbs energy associated with the golf ball. It is noted that the specific arrangement of ¾ inch to 1 inch is provided only as an example, and that implementation are not limited to such. Depending on the physical attributes of the ball, different depths and different amounts of mesh under the surface may be used.

In a nonlimiting example, the second float 130 pulls mesh 150 or a portion of the mesh 150 to, or above, the water surface 122. In another nonlimiting example, the first float 110 may pull a portion of the mesh 150 to, or above, the water surface 122. In some embodiments, both the first float 110 and the second float in combination pull mesh 150 or a portion of the mesh 150 to, or above, the water surface 122. In either of these nonlimiting examples, the pulling of the mesh 150 may cause bowing, e.g., billowing, of the mesh 150 or a portion of the mesh 150 so that the mesh 150 or a portion of the mesh 150 is submerged below the water surface 122, thereby creating a water-dampened "ball catch," e.g., a golf ball that hits golf target 100 such as the area between first float 110 and second float 130 is caught by the partially submerged mesh 150 (billowing) and/or water surface 122.

In another nonlimiting example, the inner tube 112 may be surrounded by a fabric such as a nylon fabric. In some embodiments, the spring 118 may be a polyester spring encased by spring casing 116 which may be another nylon fabric. The spring 118 gives the golf target 100, e.g., the first float 110, rigidity and acts as a folding mechanism for easy storage of the golf target 100.

Figure 7:
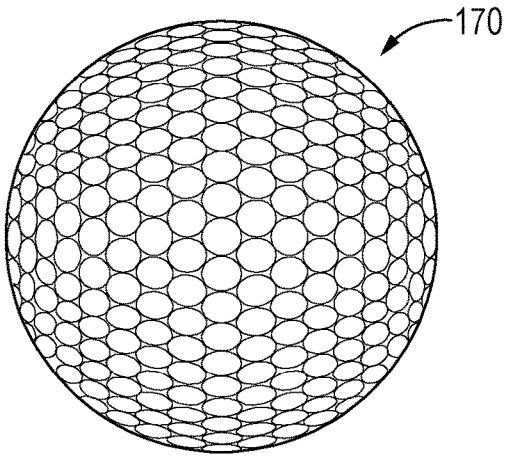
FIG. 7 shows an example golf ball used in conjunction with the golf target according to the principles of the present disclosure.

FIG. 7 is an example golf ball used in conjunction with the golf target. At least one golf ball 170 may be used in conjunction with at least one golf target 100 (e.g., as shown in FIG. 6). Golf ball 170 may be made to match the size, weight and feel of golf balls used in golf chipping and/or the game golf in general. Further, golf ball 170 may be floatable, at least in part (to float on or near the surface of the body of liquid). In a nonlimiting example, after golf ball 170 hits the golf target 100 and/or water surface 122, both shown in FIG. 6, the golf ball 170 may float on the water surface 122 and/or be in contact with at least a portion of the mesh 150, i.e., the "ball catch." The "ball catch" may also be achieved in any other sequence of contacts of the golf ball 170 with any of the components of the golf target 100.

In another nonlimiting example, a golf ball 170, e.g., a golf ball used in golf chipping, that is hit using a chip shot provides a rate of spin, e.g., produced in part by the chip shot, which may otherwise cause the golf ball 170 skip off the water. However, in accordance with the embodiments herein, the golf target 100 terminates the rate of spin or reduces the rate of spin of a golf ball 170 hit into the golf target 100 in a manner that allows the golf target to "catch" the golf ball 170, e.g., when hit into the submerged mesh 150, keeping the ball within the golf target 100.

Thus, golf ball 170 which may be floatable, e.g., floatable on the surface of the water in pool, and the golf target 100 allow any golfer to practice actual feel/touch, thereby acquiring useful experience and skill with chipping.

Figure 8:
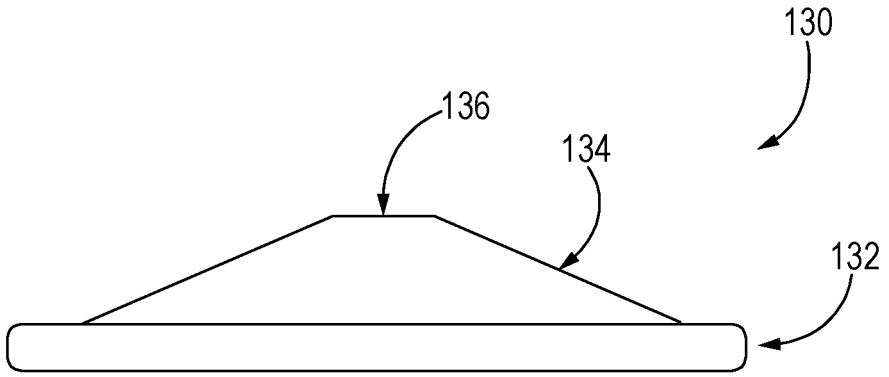
FIG. 8 shows a side view of an example second float according to the principles of the present disclosure.

FIG. 8 is a side view of an example second float. Second float 130 includes a base portion 132 and a top portion 134. Each one of the base portion 132 and the top portion 134 may have any shape. In a nonlimiting example, the base portion 132 is shaped as a disc, e.g., cylindrical, and the top portion has a frustoconical shape having a top area 136. Any one of the base portion 132, the top portion 134, and the top area 136 may cause a golf ball 170 to be caught by the golf target 100, e.g., causing the golf ball 170, after hitting the golf target 100, to be directed to the any element of the golf target 100 including the mesh 150. For example, when golf ball 170 hits second float 130, second float absorbs at least some of the energy (e.g., kinetic energy, potential energy, etc.) associated with the motion of golf ball 170 after being hit, e.g., by a golfer. The shape of second float 130 may be arranged to direct golf ball 170 to an area between first float 110 and second float 130.

Figure 9:
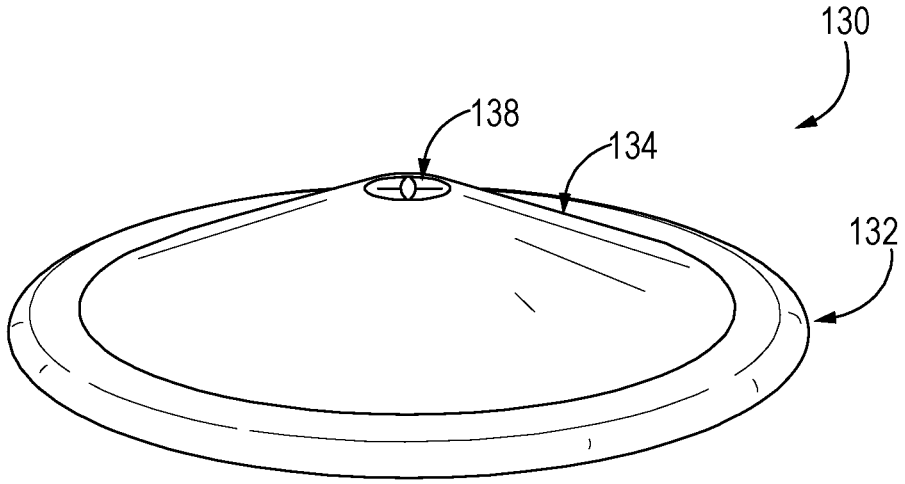
FIG. 9 shows perspective view of another example second float according to the principles of the present disclosure.
Figure 10:
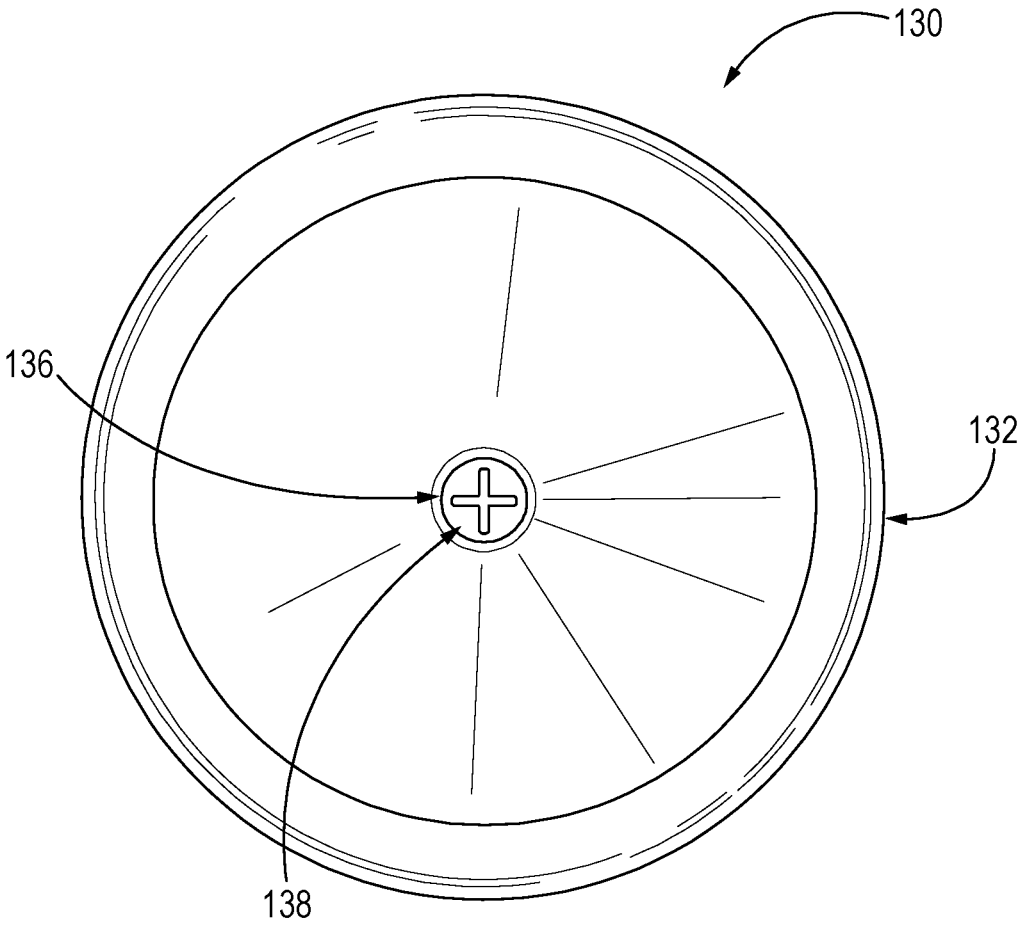
FIG. 10 shows a superior view of the second float according to the principles of the present disclosure.

FIG. 9 is perspective view of another example second float. Second float 130 may additionally include a flagpole coupler 138 within or as part of top area 136. The flagpole coupling mechanism is arranged to receive any aiming device, e.g., the flagpole 160 and/or flag 162, and couple the aiming device to the second float. The flagpole coupler 138 is also shown in FIG. 10 as part the top area 136. FIG. 10 shows a superior view of the second float 130 shown in FIG. 9.

Figure 11:
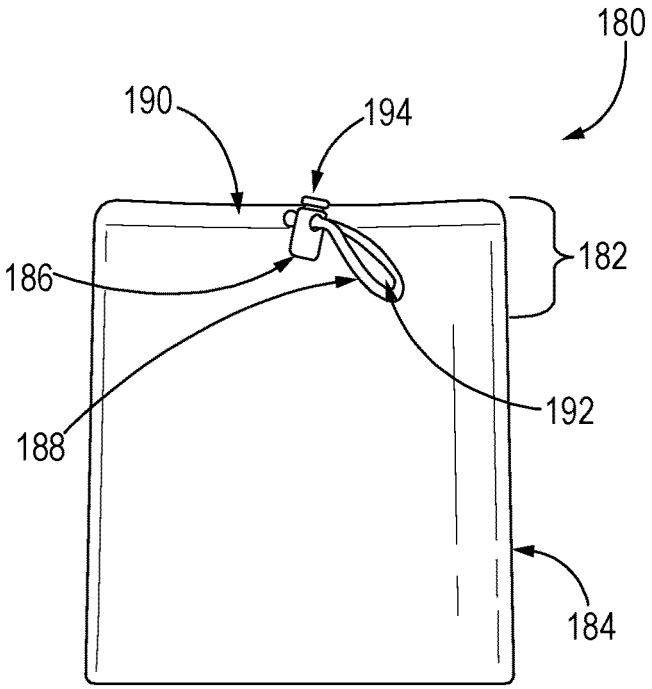
FIG. 11 shows a side view of an example anchor bag in an open condition according to the principles of the present disclosure.

FIG. 11 shows a side view of an example anchor bag 180 in an open condition. Anchor bag 180 includes an anchor attachment 182 and an anchor bag body 184. The anchor attachment 182 includes a drawstring lock 186, e.g., a toggle cinch, a drawstring 188, and a drawstring channel 190. The drawstring 188 may be slidable through the drawstring lock 186 and/or the drawstring channel 190. The drawstring lock 186 may be in a locked and/or an unlocked position. In the unlocked position the drawstring 188 can slide through the drawstring lock 186 and/or the drawstring channel 190. In the locked position the drawstring 188 is prevented from sliding through the drawstring lock 186. Further, in the locked position the drawstring lock 186 may prevent the drawstring 188 from sliding through drawstring channel 190. Each one of the drawstring lock 186 and the drawstring channel 190 may include at least an opening for the drawstring 188 or a portion of the drawstring 188 to pass through and/or slide. An attachment loop 192 may be created, e.g., by unlocking the drawstring lock 186, pulling the drawstring 188. The attachment loop 192 can be created any other way.

Further, anchor bag 180 may include at least an adjustable opening 194, which may be adjusted to an open or a closed condition at least in part by pulling/releasing the drawstring 188 and/or locking/unlocking the drawstring lock 186. The adjustable opening 194, e.g., when in the opened condition, may be used to load the anchor bag at least with a weight, e.g., sand, rocks, etc. Loading weight to the anchor bag allows the anchor bag to submerge, e.g., sink to the bottom of a pool.

Figure 12:
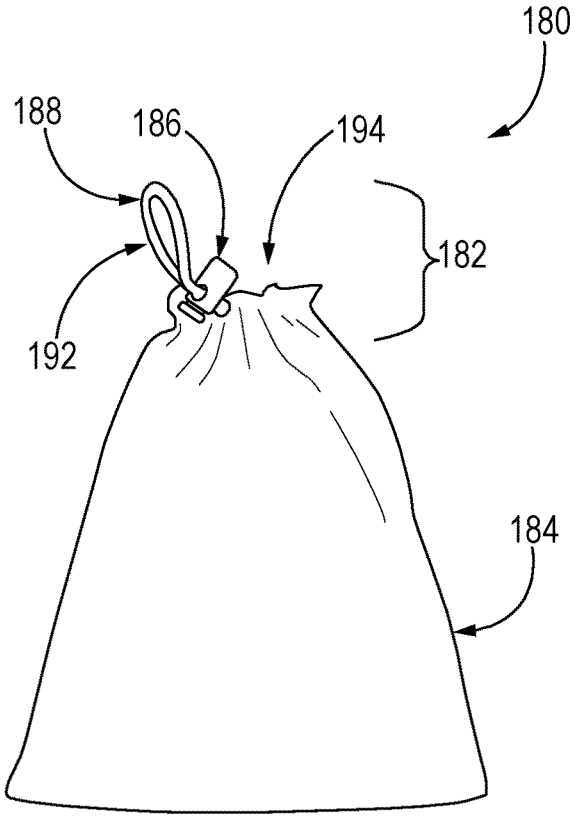
FIG. 12 shows an example anchor bag in a closed condition according to the principles of the present disclosure.

FIG. 12 shows an example anchor bag in a closed condition. The adjustable opening 194 is in the closed condition, the drawstring 188 has been pulled, and the drawstring lock 186 has been locked. The anchor bag 180, e.g., the anchor bag body 184, includes at least a weight, e.g., sand, previously loaded when the adjustable opening 194 was in the open condition. Depending on the weight type, e.g., fill material, the anchor bag 180 may sit up, lay on a side of the anchor bag 180, or a combination thereof. Having the adjustable opening 194 in the closed condition prevents the weight from leaving the anchor bag 180 and/or creates attachment loop 192, which may be tied to the golf target 100.

Figure 13:
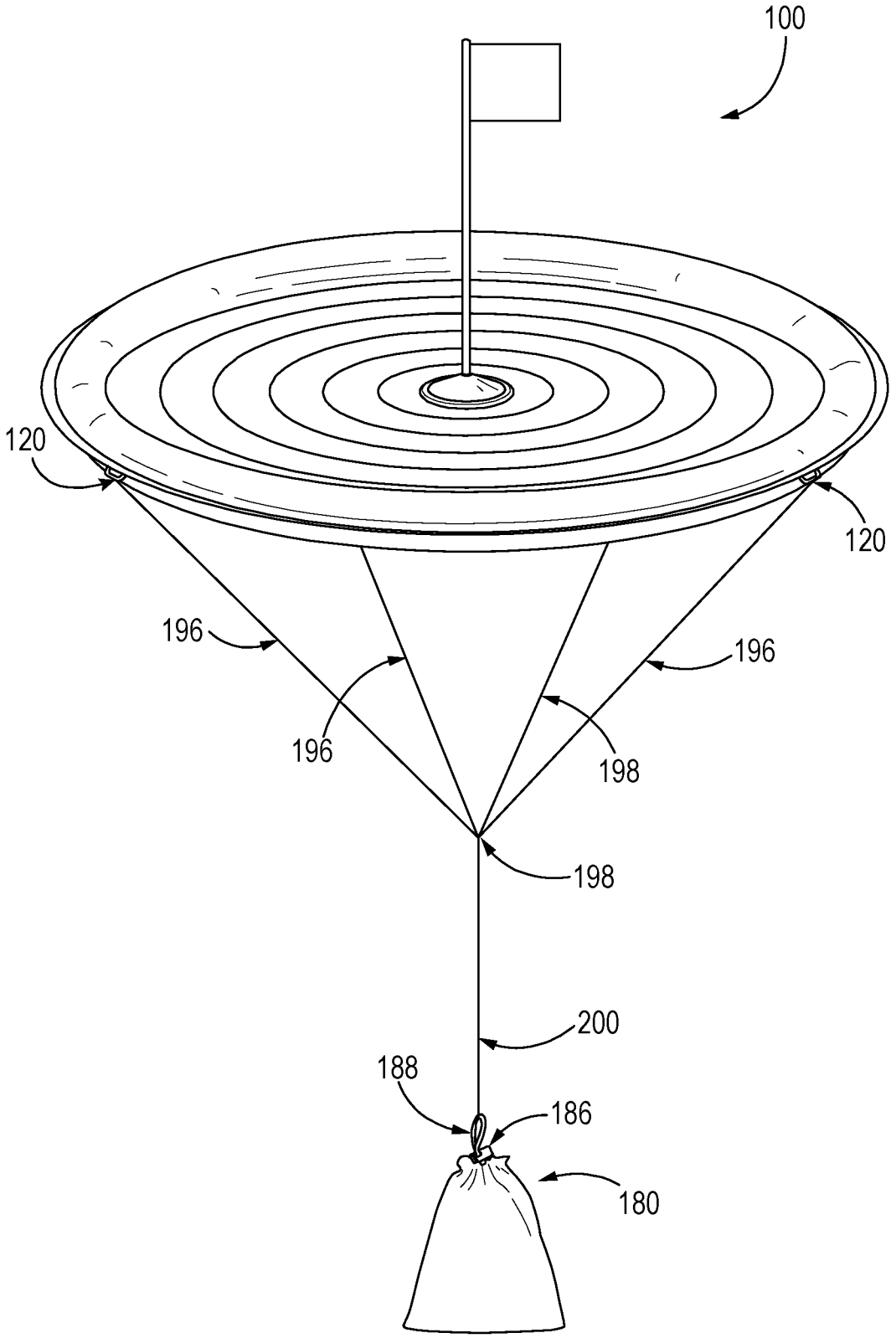
FIG. 13 shows an example golf target anchored to an anchor bag according to the principles of the present disclosure.

FIG. 13 shows an example golf target anchored to an anchor bag. Golf target 100 may also include a plurality of loops 120 and/or a plurality of cords 196. An end of each cord of the plurality of cords 196 may be tied to one or more loop of the plurality of loops 120. Another end of each cord of the plurality of cords 196 may be tied at tie point 198 to the other end of the other cords of the plurality of cords 196. The other end of each cord 196 may be tied another golf target 100, or another surface/device that is not necessarily part of the golf target 100, e.g., a pool edge. Further golf target 100 may include anchor cord 200 having one end tied to tie point 198 and another end tied to the anchor bag 180, e.g., by tying to the drawstring 188 on the attachment loop 192.

Thus, golf target 100 as shown in FIG. 13 is tied to the anchor bag 180, which includes at least an anchor weight. The anchor weight causes the anchor bag 180 to sink in the body of water and prevent the golf target 100 from moving away from a predefined area of the body of water. In addition, anchor bag 180 and/or the exterior of the anchor bag body 184 protects at least a pool surface, e.g., a pool liner, by serving as a barrier between the pool surface, e.g., the pool liner, and weights in the anchor bag, e.g., that are used to hold the golf target 100 in place. Although anchor bag 180 is described as a bag, anchor bag 180 is not limited to being a bag and may refer to any weight (e.g., denser than water) arranged to providing anchoring to golf target 100.

Having described the general features of the floating golf target of the disclosure, the sections below provide additional details and examples.

In some embodiments, each of the golf targets 100, e.g., circular floatable targets, have a first float 110, e.g., including an inner tube 112 that is inflatable, as the outside perimeter, and is wrapped with a fabric such as a nylon fabric. One or more loops 120 are sewn into first float, e.g., on an outer surface of the first float 110 near or on an outer perimeter of the first float 110. The loops 120 are used for tethering the golf targets 100, e.g., circular floatable targets, if desired. The first float 110 may also include a spring 118, e.g., a fiberglass rod that acts like a spring, around an outer perimeter and allows each golf target 100 to be folded down to a smaller size, e.g., a third or one half of the size of the golf target 100 when unfolded. Mesh 150 may be a mesh fabric that is sewn to the first float 110, e.g., on a nylon fabric of the first float 110. The mesh 150 may sit at and/or just below the water surface 122. At least a portion of mesh 150 may be above the water surface 122. The mesh 150 may be made of a material that accepts (e.g., catches, receives, traps, absorbs energy of) golf balls 170 after being hit into the golf target 100, e.g., rather than slide or bounce out of the golf target 100. A 4" circular piece of hook and loop fastener may be sewn into the center of the mesh 150 and attached to the second float 130, e.g., a custom molded, floatable, Ethylene-Vinyl Acetate (EVA) rubber flag holder with a hook and loop fastener bottom. A flagpole 160 having at least a flag 162, e.g., a miniature golf flag, attached is inserted into the second float 130, e.g., the rubber flag holder. The flagpole 160 and/or the flag 162 may be used as aiming mechanisms to the center of the golf target 100. Also included is 30 feet of cord, e.g., stretchable tethering cord, which can be turned in to a plurality of cords 196 and/or anchor cord 200. Further, clips for securing the cord and/or the plurality of cords 19 are provided.

In one embodiment, one or more golf targets 100 float on a swimming pool. At least one loop 120 is used in conjunction with at least one cord 196 to tie golf target 100 to anchor bag 180, which includes rocks that cause anchor bag 180 to sink to the bottom of the swimming pool and become stationary. Further, another loop 120 and another cord 196 may be used to tie golf target 100 to a stationary object in the swimming pool area, e.g., step of the swimming pool ladder shown in FIG. 1. Golf target 100 include second float 130 which is a golf hole having a predetermined volume arranged to receive at least one golf ball 170 and hold a predetermined quantity of golf balls 170, e.g., four golf balls 170. Further, mesh 150 in conjunction with other components of golf target 100 are arranged to receive golf balls 170 (i.e., "ball catch"). In one example of this embodiment, a golfer hits seven golf balls 170, each golf ball of a first group of golf balls 170, e.g., three golf balls, hits golf target 100 (e.g., first float 110, second float 130, mesh 150). The energy from the motion of each golf ball 170 is at least partially absorbed by golf target 100, and each golf ball 170 is received by the golf hole of second float 130. Each golf ball of a second group of golf balls 170 (e.g., the four golf balls 170) hits golf target 100 (e.g., first float 110, second float 130, mesh 150). The energy from the motion of each golf ball 170 of the second group is at least partially absorbed by golf target 100. Each golf ball 170 of the second group is received at least by mesh 150 that is partially submerged. Put differently, in this nonlimiting example, a first group of golf balls 170 is caught/received by second float 130, and a second group of golf balls 170 is caught/received by at least mesh 150, i.e., trapped between first float 110 and second float 130.

In some embodiments, a golf training system is described. The golf training system may include golf target 100 (and/or any component of golf target 100 of the present disclosure). Further, the golf training system may include at least a floatable golf ball which may be arranged to be receivable at least in part by at least one of the first float, the second float, the mesh, and/or any other component of golf target 100. The golf training system may include a carrying case. The carrying case may be arranged to receive and/or store golf target 100 and/or any other components of golf target 100 and/or the golf training system. The carrying case may include a case mesh arranged to permeate water out of the golf training system and/or allow for environment air to enter the golf training system. In some other embodiments, the components described above may be packaged in a custom circular/cylindrical shaped reusable carrying case. The carrying case may be made from a nylon backpack type of material. The carrying case may also be branded with an embroidered logo and/or have a mesh, e.g., at the bottom of the carrying case, to ensure that any moisture remaining in the golf targets 100 is allowed to drain, thereby preventing mold growth when in storage.

It will be appreciated by persons skilled in the art that the present embodiments are not limited to what has been particularly shown and described herein above. In addition, unless mention was made above to the contrary, it should be noted that all of the accompanying drawings are not to scale. A variety of modifications and variations are possible in light of the above teachings.

What is claimed is:

1. A golf target for use on a body of water having a water surface, the golf target comprising:

a first float having a first diameter;

a second float having a second diameter smaller than the first diameter;

a mesh having an outer perimeter, a mesh center, and a middle portion extending between the outer perimeter and the mesh center, the outer perimeter of the mesh being affixed to the first float, the mesh center being affixed to the second float;

a spring coupled to the first float, the spring being arranged to exert a biasing force at least on one of the first float and the outer perimeter of the mesh, at least one of the first float and the outer perimeter of the mesh being pulled away from the second float when the biasing force is applied; and at least a part of the middle portion being arranged to submerge under the water surface when the golf target is floated on the body of water.

2. The golf target of claim 1, wherein the first float includes an inner tube surrounded by a fabric having at least an outer surface, the spring being coupled to the outer surface.

3. The golf target of claim 2, wherein the first float further includes a spring casing attached to the outer surface of the fabric and encasing the spring, the spring being indirectly coupled to the outer surface by being encased by the spring casing.

4. The golf target of claim 2, wherein the outer surface of the fabric surrounding the inner tube of the first float includes at least a bottom outer surface, and the outer perimeter of the mesh is affixed to the first float by being affixed to the bottom outer surface, at least a part of the bottom outer surface being submerged under the water surface when the golf target is floated on the body of water.

5. The golf target of claim 1, wherein the second float at least one of:

is molded:

is disc shaped; and includes a base portion and a top portion having a conical shape.

6. The golf target of claim 5, wherein the golf target further includes an aiming device, the aiming device including a flagpole and a flag attached to the flagpole, the flagpole having at least a flagpole bottom portion, the conical shape of the top portion of the second float being a truncated cone having at least a top area, the top area including a flagpole coupling mechanism, the flagpole coupling mechanism receiving the flagpole bottom portion to couple the flagpole to the second float.

7. The golf target of claim 5, wherein the base portion of the second float includes a base portion bottom surface, and the mesh center is affixed to the second float by being affixed to the base portion bottom surface, at least a part of the base portion bottom surface being submerged under the water surface when the golf target is floated on the body of water.

8. The golf target of claim 1, wherein at least the part of the middle portion of the mesh is arranged to submerge under the water surface when the golf target is floated on the body of water by having a concave cross section between the outer perimeter of the mesh and the mesh center.

9. The golf target of claim 2, wherein the first float further includes a plurality of cords and a plurality of loops, each loop of the plurality of loops being affixed to the first float, each cord of the plurality of cords having a first cord end and a second cord end, the first cord end of each cord of the plurality of cords being tied to one corresponding loop of the plurality of loops.

10. The golf target of claim 9, wherein the second cord end of each cord of the plurality of cords is tied to any one of another golf target, a surface containing the body of water, and each other second cord end of each cord.

11. The golf target of claim 9, wherein each loop of the plurality of loops is affixed to the outer surface of the fabric surrounding the inner tube of the first float.

12. The golf target of claim 9, wherein the golf target further includes an anchor bag and an anchor cord, the anchor cord having a first anchor cord end and a second anchor cord end, the first anchor cord end being tied to the second cord end of each cord of the plurality of cords, the second anchor cord end being tied to the anchor bag.

13. The golf target of claim 12, wherein the anchor bag includes an anchor attachment having a drawstring in form of a loop, a drawstring channel, and a drawstring lock, the drawstring being slidable through the drawstring channel and through the drawstring lock, the drawstring lock having an unlocked position and a locked position, the drawstring lock preventing the drawstring from sliding through the drawstring lock and creating an attachment loop when in the locked position.

14. The golf target of claim 13, wherein the second anchor cord end is tied to the anchor bag by tying the second anchor cord end to the drawstring on the attachment loop.

15. The golf target of claim 12, wherein the anchor bag is arranged to receive an anchor weight, the anchor weight causing the anchor bag to sink in the body of water and keeping the golf target within a predefined area of the body of water.

16. A golf target for use on a body of water having a water surface, the golf target comprising:

a first float having a first diameter, the first float including an inner tube surrounded by a fabric having at least an outer surface, the outer surface of the fabric surrounding the inner tube of the first float including at least a bottom outer surface;

a second float having a second diameter smaller than the first diameter;

a mesh having an outer perimeter, a mesh center, and a middle portion extending between the outer perimeter and the mesh center, the outer perimeter of the mesh being affixed to the first float, the mesh center being affixed to the second float, the outer perimeter of the mesh being affixed to the first float by being affixed to the bottom outer surface; and at least a first part of the middle portion of the mesh and a second part of the bottom outer surface being arranged to submerge under the water surface when the golf target is floated on the body of water, the at least first part having a concave cross section between the outer perimeter of the mesh and the mesh center.

17. A golf training system comprising:

a golf target for use on a body of water having a water surface, the golf target comprising:

a first float having a first diameter, the first float including an inner tube surrounded by a fabric having at least an outer surface, the outer surface of the fabric surrounding the inner tube of the first float including at least a bottom outer surface;

a second float having a second diameter smaller than the first diameter;

a mesh having an outer perimeter, a mesh center, and a middle portion extending between the outer perimeter and the mesh center, the outer perimeter of the mesh being affixed to the first float, the mesh center being affixed to the second float, the outer perimeter of the mesh being affixed to the first float by being affixed to the bottom outer surface;

at least a first part of the middle portion of the mesh and a second part of the bottom outer surface being arranged to submerge under the water surface when the golf target is floated on the body of water, the at least first part having a concave cross section between the outer perimeter of the mesh and the mesh center; and at least a floatable golf ball, the at least floatable golf ball being receivable at least in part by at least one of the first float, the second float, and the mesh.

18. The golf training system of claim 17, wherein the second float is a golf hole arranged to receive the at least floatable golf ball.

19. The golf training system of claim 17, further including a carrying case having a case mesh.

* * * * *